US010228211B2

(12) United States Patent
Knutson

(10) Patent No.: US 10,228,211 B2
(45) Date of Patent: Mar. 12, 2019

(54) PORTABLE FIREARM STAND TECHNOLOGY

(71) Applicant: Gordon Knutson, Beldenville, WI (US)

(72) Inventor: Gordon Knutson, Beldenville, WI (US)

( * ) Notice: Subject to any disclaimer, the term of this patent is extended or adjusted under 35 U.S.C. 154(b) by 0 days.

(21) Appl. No.: 15/350,154

(22) Filed: Nov. 14, 2016

(65) Prior Publication Data

US 2018/0135934 A1 May 17, 2018

(51) Int. Cl.
*F41A 23/00* (2006.01)
*F41A 23/02* (2006.01)
*F41A 23/12* (2006.01)

(52) U.S. Cl.
CPC ..... *F41A 23/02* (2013.01); *F41A 23/12* (2013.01)

(58) Field of Classification Search
CPC ..... F41A 23/16; F41A 23/02; F41A 23/12; F41A 23/10; F41A 23/14
USPC ..... 42/94; 89/37.04, 40.06; 73/167
See application file for complete search history.

(56) References Cited

U.S. PATENT DOCUMENTS 2,847,909 A * 8/1958 Kester ..... F41A 23/00 42/94
2,870,683 A * 1/1959 Wilson ..... F41A 23/12 42/94
3,016,802 A * 1/1962 Grunenberg ..... F41A 23/12 248/186.2
3,863,376 A * 2/1975 Dalmaso ..... F41A 23/00 248/166
4,790,096 A * 12/1988 Gibson ..... F41A 23/58 42/94
4,967,497 A * 11/1990 Yakscoe ..... F41A 23/14 42/94
5,060,410 A * 10/1991 Mueller ..... F16M 11/08 42/94
5,123,550 A * 6/1992 Nodskov ..... A47F 5/13 211/182
5,284,280 A * 2/1994 Stonebraker, Sr. ..... A45F 4/02 224/153
5,402,595 A * 4/1995 Tamllos ..... F41A 23/10 42/94
5,419,233 A * 5/1995 Mulvaney ..... F41A 23/16 42/94
5,697,180 A * 12/1997 Morizio ..... F41A 23/02 42/94

(Continued)

FOREIGN PATENT DOCUMENTS

WO WO-0065950 A1 * 11/2000 ..... A01M 31/02

*Primary Examiner* — Michael D David
(74) *Attorney, Agent, or Firm* — Skinner & Associates; Joel Skinner

(57) ABSTRACT

A portable, firearm support stand. The stand has a foldable, collapsible and expandable leg system, a handle connected to the leg system, and a firearm support also connected to the leg system. The foldable leg system includes first, second, third and fourth legs, each leg having a bottom, a top region and a midpoint region. The top regions of the first and third legs are pivotally connected to each other. The top regions of the second and fourth legs are pivotally connected to each other. The midpoint regions of the first and second legs are pivotally connected to each other. And the midpoint regions of the third and fourth legs are pivotally connected to each other. The handle is disposed at the top region of one leg. The firearm support is disposed at the top region of one leg.

6 Claims, 10 Drawing Sheets

(56) References Cited

U.S. PATENT DOCUMENTS

| | | | | | |
|---|---|---|---|---|---|
| 5,913,668 | A * | 6/1999 | Messer | F41A 23/16 | 42/94 |
| 5,930,932 | A * | 8/1999 | Peterson | F41A 23/16 | 42/94 |
| 5,930,933 | A * | 8/1999 | Schleicher | F41A 23/16 | 42/94 |
| 6,086,027 | A * | 7/2000 | Klimbacher | F16M 11/32 | 211/189 |
| 6,192,613 | B1 * | 2/2001 | Lantz | F41A 23/12 | 42/94 |
| 7,334,837 | B1 * | 2/2008 | Long | A01M 31/02 | 297/16.2 |
| 7,676,977 | B1 * | 3/2010 | Cahill | F16M 11/16 | 248/168 |
| 7,784,212 | B1 * | 8/2010 | Chilton | F41A 23/16 | 42/94 |
| 8,024,883 | B1 * | 9/2011 | Boord | F41C 33/003 | 42/90 |
| 8,955,247 | B2 * | 2/2015 | Sargent | F41A 23/02 | 248/165 |
| 9,097,481 | B2 * | 8/2015 | Chaney | F41A 23/14 | |
| 2004/0020097 | A1 * | 2/2004 | Deros | F41A 23/02 | 42/94 |
| 2004/0134113 | A1 * | 7/2004 | Deros | F41A 23/02 | 42/94 |
| 2009/0126250 | A1 * | 5/2009 | Keng | F41A 23/10 | 42/94 |

* cited by examiner

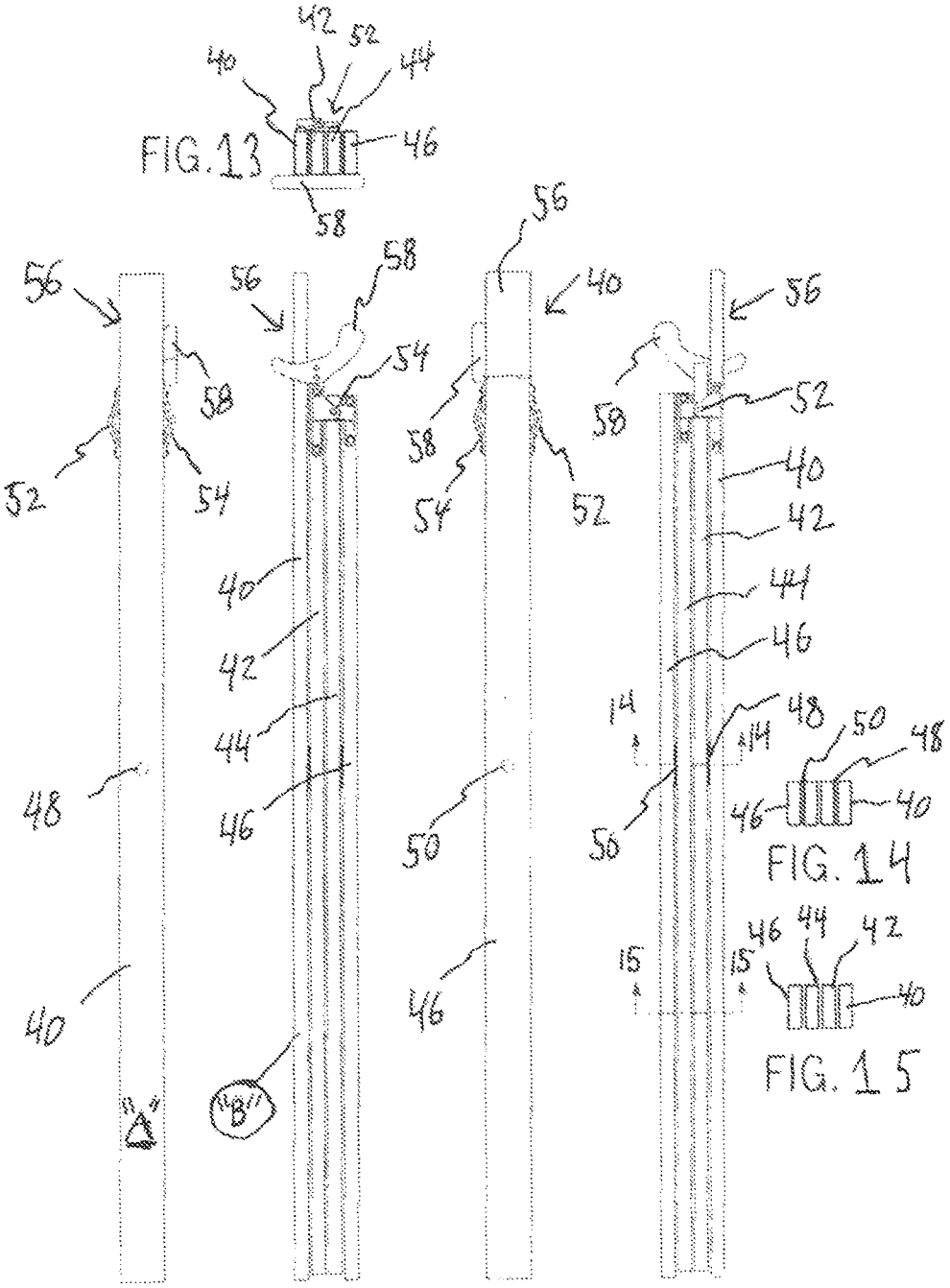
FIG. 13
FIG. 14
FIG. 15
FIG. 10
FIG. 8
FIG. 11
FIG. 9
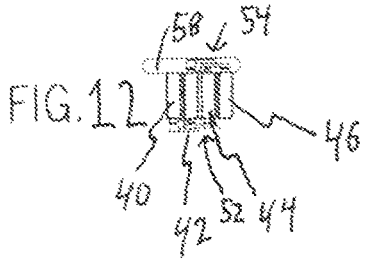
FIG. 12

PORTABLE FIREARM STAND TECHNOLOGY

37 C.F.R. § 1.71(e) AUTHORIZATION

A portion of the disclosure of this patent document contains material which is subject to copyright protection. The copyright owner has no objection to the facsimile reproduction by anyone of the patent document or the patent disclosure, as it appears in the US Patent and Trademark Office patent file or records, but otherwise reserves all copyright rights whatsoever.

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND

1. Field

The present invention relates, generally, to stands and to firearms systems, apparatus and methods. More particularly, the invention relates to a portable firearm support stand, and methods of making the stand and using the stand. The system, apparatus and method of the invention are useful for hunting, marksman, police and military applications.

2. Background Information

Since the advent of firearms, shooters have sought better means of stabilizing those firearms when firing. A nearby tree or rock would generally suffice, unless there were none available. Stabilizing body positions were tried, the best among them being prone, but often ground vegetation rendered this method useless. Firearm-stabilizing devices that could be carried by the shooter and employed quickly when needed were next. Some types explored over time were walking sticks, (monopods), folding bipods and tripods, and collapsible models, which all had the drawback of only one rifle rest point on top of the device.

More recently, this shortcoming was addressed by the quad-pod, or four-legged shooting stick. Examples of these include WO200065950, comprised of four quadrants arranged around a central axis, described thusly: "The stick is divided by two planes of symmetry vertical (perpendicular) to each other passing through the central axis of the stick." This device has two forked ends comprised of the portions of the rods above the upper pivot points, which provide rests for the fore end and the butt of the rifle. Touted as a multi-purpose tool—walking stick, shooting rest, fish pole holder, and the like,—it has undesirable limitations as a rifle rest. This device must be opened in both hinge directions simultaneously, "by simultaneous pushing of the pairs of the main rods connected by hinged links in free directions of hinges . . . ", which can be accomplished without much difficulty using a model constructed per the example designed for standing shooting on two ground-contact points, but is very difficult using models of the shorter examples designed for kneel-down shooting on three and four ground-contact points, due to hinging interference of an impracticable geometric design. Shooting while standing is acceptable in itself, but the device used for standing shooting is roughly as long as the user is tall, making it necessary to carry the stick in the hand at all times, which is impractical when faced with tasks such as climbing, crawling, riding a four-wheeler or horseback, etc., and the full-height profile of the shooter is more susceptible to wind-induced instability.

DE202004015727 describes four stacked legs, with upper hinging accomplished via rivets or bolts linking sequential legs 1-2 and sequential legs 3-4, and with lower hinging done via baseplates linking sequential legs 1-4 and sequential legs 2-3, resulting in only two ground contact points, which is insufficient to provide the desired level of stability. Stability is enhanced via complication—by adding an optional fifth stabilizing leg.

Other devices exist, including (A) of a variety which has only two ground-contact points, which doesn't provide the required stability for long-range shooting, especially when the user is short of breath from exertion, and which won't stand unassisted, requiring the user to prop it up while readying the rifle for use; (B) of the four-post, central axis design, which can be difficult to open into usable form, particularly in shorter designs providing more than two points of ground-contact, due to hinging interference of an impracticable geometric design; and (C) of a variety which has only one upper support point (bipods, tripods, etc.) which also doesn't provide the necessary aiming stability.

The background technology is believed to have significant limitations and shortcomings. For these and other reasons, a need exists for the present invention.

All US patents and patent applications, and all other published documents mentioned anywhere in this application are hereby incorporated by reference in their entirety.

BRIEF SUMMARY

The present invention provides an portable firearm support stand apparatus and method which are practical, reliable, safe, accurate and efficient, and which are believed to fulfill a need and to constitute an improvement over the background technology.

In one aspect, the invention relates to stand for a firearm when the firearm is in use, comprising

- a foldable leg system including first, second, third and fourth legs, each leg having a bottom, a top region and a midpoint region, the top regions of the first and third legs being pivotally connected to each other, the top regions of the second and fourth legs being pivotally connected to each other, the midpoint regions of the first and second legs being pivotally connected to each other, and the midpoint regions of the third and fourth legs being pivotally connected to each other;
- a handle disposed at the top region of at least one leg; and
- a firearm support disposed at the top region of at least one leg.

In another aspect, the invention relates to lightweight, portable, collapsible firearm stand for holding a firearm steady when the firearm is in use, comprising (a) a foldable leg system including first, second, third and fourth legs, each leg having a bottom, a top region and a midpoint region, the top regions of the first and third legs being pivotally connected, via a hinge, to each other, the top regions of the second and fourth legs being pivotally connected, via a hinge, to each other, the midpoint regions of the first and second legs being pivotally connected, via a pivot pin, to each other, and the midpoint regions of the third and fourth legs being pivotally connected, via a pivot pin, to each other, wherein:

(i) the leg system has a first, folded, state wherein the first, second, third and fourth legs are coextensively aligned with each other, and a second, unfolded, state wherein the legs are non-aligned with each other, the first and second legs forming a generally X shaped configuration with respect to each other, and the third and fourth legs forming a generally X shaped configuration with respect to each other, and (ii) the top pivotal connections are in a plane perpendicular to the plane of the two midpoint region pivotal connections;

(b) a handle disposed at the top region of the first leg;

(c) a firearm support disposed at the top of the pivotal connection of the second and fourth legs; and (d) a shoulder harness connected to the leg system.

In a further aspect, the invention provides a device with more than two ground-contact points to provide primarily vertical aiming stability and free-standing capability, and with two rifle support points to provide primarily horizontal aiming stability, that is lightweight (<2 lbs.), and can be set up quickly (<5 seconds). This permits the user to carry the device for long periods of time without wearying of the burden, to quickly set up the device when game is sighted, to then have both hands free to un-sling and settle the rifle into the support, and to hold the rifle steady in both the horizontal and vertical directions, even if winded from exertion, for a quick and accurate shot.

The aspects, features, advantages, benefits and objects of the invention will become clear to those skilled in the art by reference to the following description, claims and drawings.

BRIEF DESCRIPTION OF THE SEVERAL VIEWS OF THE DRAWING

The present invention, and the manner and process of making and using it, will be better understood by those skilled in the art by reference to the following drawings.

FIG. 8 is a front, side view of the firearm support in the undeployed state for storage or transportation.

FIG. 9 is a back view of the firearm support of FIG. 8.

FIG. 10 is a left side view of the firearm support.

FIG. 11 is a right side view of the firearm support.

FIG. 12 is a bottom view of the firearm support.

FIG. 13 is a top view of the firearm support.

FIG. 14 is a crossectional view of the firearm support taken along line 14-14 of FIG. 9.

FIG. 15 is a crossectional view of the firearm support taken along line 15-15 of FIG. 9.

FIG. 17 B is a top view of various stages of deployment of yet another embodiment of the device.

DETAILED DESCRIPTION

Figure 1:
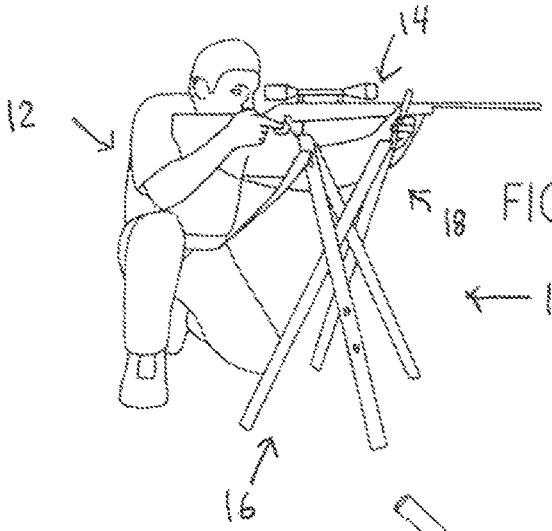
FIG. 1 illustrates an embodiment of a portable firearm support stand of the present invention deployed in use for supporting a rifle being used by a user.

FIG. 1 shows an embodiment of a portable firearm support stand 10 being used by a hunter or marksman 12 to aim and stabilize a rifle 14 during use. The stand 10 is fully deployed and has a bottom area 16 that rests on the ground and a top area 18 adapted for contact with the rifle 14 or other firearm (for example a handgun 20, in FIG. 7).

The rifle is placed in shooting position atop the device as the right elbow rests firmly on the right knee, with the portion of the rifle just forward of the trigger guard landing in the rifle saddle, and the fore-end supporting hand grasping the gripping post and/or upper leg in a position appropriate for achieving the desired elevation of the rifle muzzle. Typically the index finger wraps around and supports the rifle, the thumb rests against the near, rifle side of the gripping post or leg, and the remaining fingers wrap around the far side of the gripping post or leg, depending on the muzzle elevation required. This adjustability of rifle muzzle elevation is one reason for the preference of landing the rifle in the saddle forward of the trigger guard. If the scissors-direction opening angle limit were increased, the rifle could be landed in the saddle farther back toward the butt, but elevation adjustability would be decreased due to increased distance between the two points of rifle contact with the device.

Figure 2:
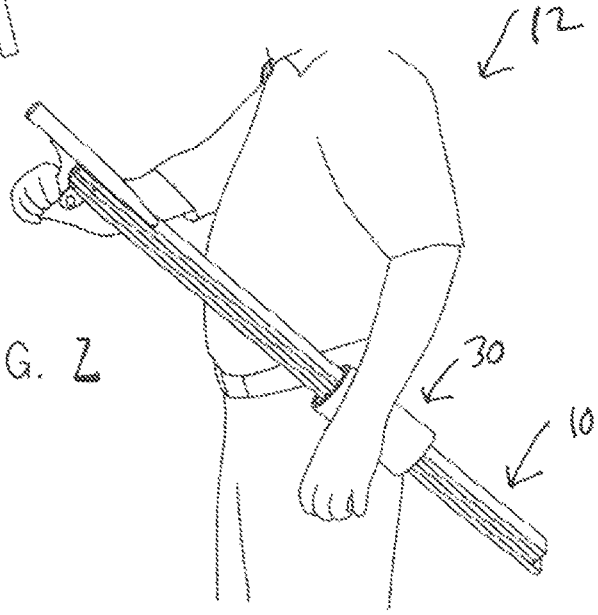
FIG. 2 illustrates the firearm support in an undeployed state for transportation by the user, and wherein the user is grasping the firearm support at his side for deployment purposes.
Figure 3:
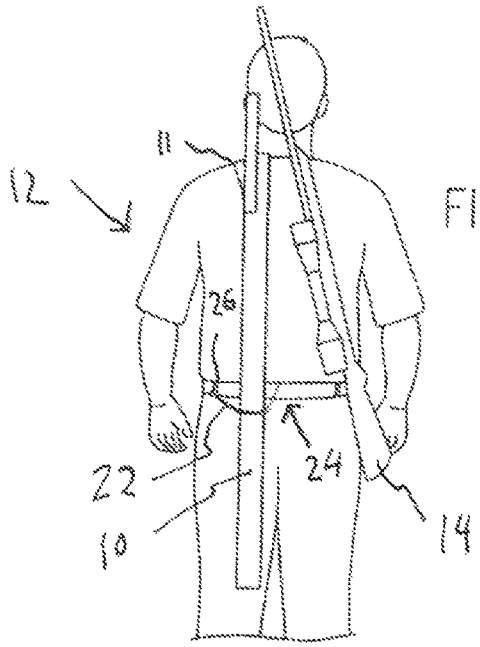
FIG. 3 is another view of the firearm support in an undeployed state, wherein the firearm support is being transported on the back of the user.
Figure 4:
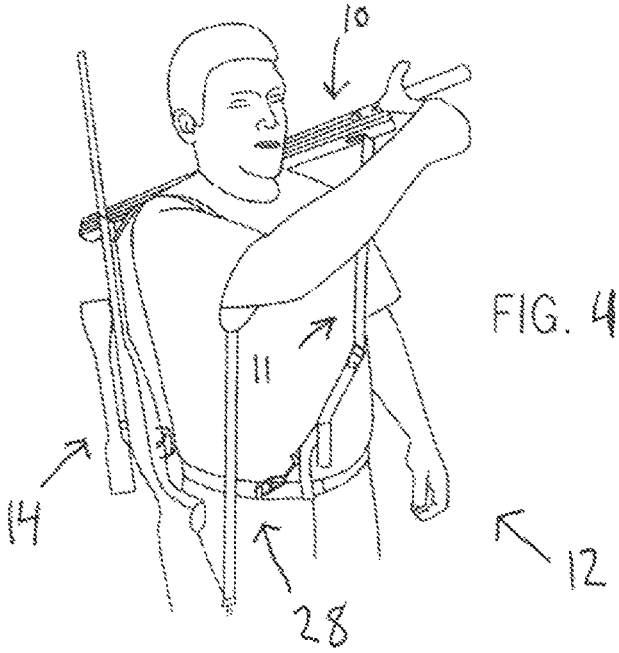
FIG. 4 is another view of the firearm support, wherein the user is grasping the firearm support over his shoulder for deployment purposes.

FIGS. 2, 3 and 4 show the stand 10 in an undeployed state for transportation. FIG. 2 shows the stand 10 folded and being inserted or otherwise coupled to a carrier 30 strapped to the waist and at the side of the user 12. In this embodiment, the carrier is a sheath or holster. FIG. 3 shows the stand moved to the back of the user 12 for carrying by way of a shoulder harness 11. FIG. 4 shows the user 12 retrieving the stand 10 over his shoulder.

Referring to FIG. 2, in this embodiment, the carrier is a sheath or holster. It may be desirable to carry either the rifle version or the handgun version of the device in a holster. Advantages of the hip-draw method of carry and deployment over the shoulder-slung method include slightly faster deployment times and carrying convenience when wearing a backpack or bulky clothing. Another advantage, particularly with the handgun version of the device, is the ability to draw and deploy the device with one hand, as described below in regard to FIG. 7.

FIG. 3 shows the stand 10 moved to the back of the user 12 for carrying by way of a shoulder sling 11, to enable ease of transport in the field, and instant access to the device for quick setup and use. The shoulder sling, preferably adjustable in length, and about 20" to 45" long, sometimes about 28" to 32" long when adjusted for use, is attached on one end 1" to 10", sometimes about 3" to 5", from the top of one of the legs, preferably leg 4. Desirably, an elastic restraining cord or band 22, 5" to 14" in length, and sometimes 7" to 10" in length, is fastened to a rear belt loop 24, or to an optionally included belt to be worn with the device, preferably about in the center of the user's back. When the device is in the slung position, the lower, free end of the device can be secured by looping the cord or band around the device and securing the unattached end, as with a hook or other means, to an outer belt loop 26 or a loop on an optionally included belt, preferably on the left side of a right-handed user. This restraining cord prevents the device from swinging loosely while the user is engaged in strenuous or awkward activities such as climbing, crawling, rolling, ducking under obstacles, etc. Additionally, a groove, or peg or other protrusion may be provided on the outer surface of the leg opposite the leg of sling attachment, at some distance above the point where the restraining cord would normally cross this surface in the slung and restrained condition, over which the cord can be hooked, to hold the device downward for additional stability of the device during bending and twisting motions of the user.

FIG. 4 shows the user 12 retrieving the stand 10 over his shoulder, and shows the other end of the shoulder sling 11 attached, preferably by a hook or carabiner, to a front belt loop 28, or a loop in an optionally included belt to be worn with the device. The front loop is preferably located slightly to the right of center for a right-handed user, and the device is slung over the left shoulder, opposite the typical carrying shoulder for a slung rifle. In this complete configuration, the user can effortlessly carry the device in a ready position, and when game or other target is sighted, and a quick shot is required, a right-handed user, for example, would quickly unhook the restraining cord or band with the left hand while grasping the rifle saddle with the right hand and pulling the device over the left shoulder. Optionally, the sling can be pulled upward and forward with a thumb, thereby drawing the device over the shoulder.

Figure 5:
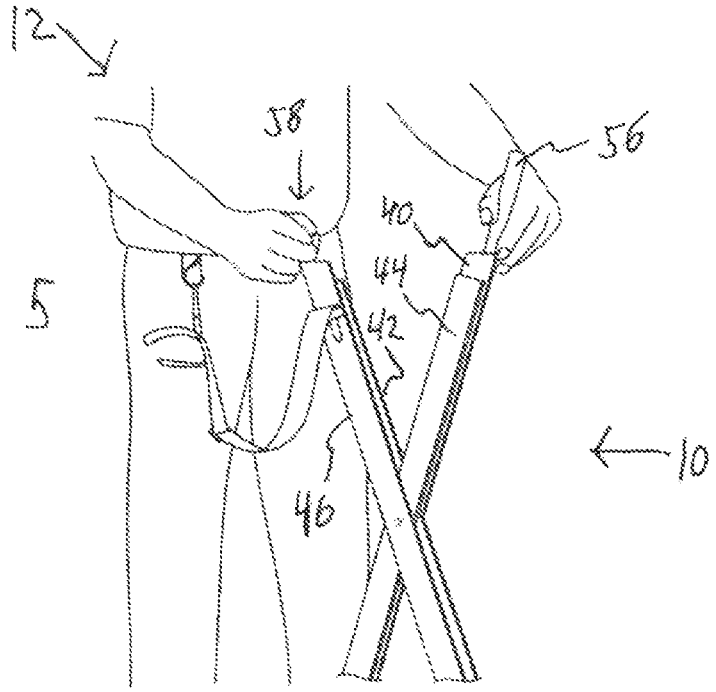
FIG. 5 illustrates the user having removed the firearm support from his transportation position and grasping the top of the firearm support in an early stage of deployment.
Figure 6:
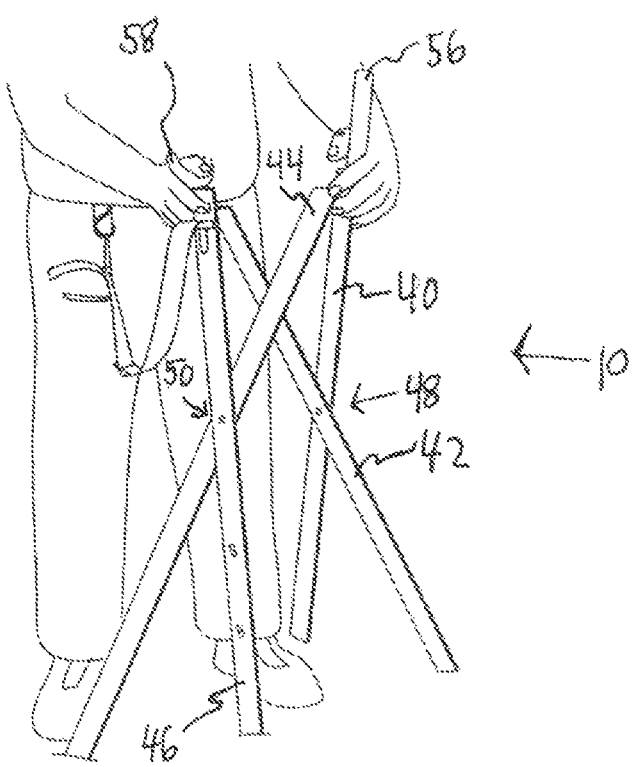
FIG. 6 illustrates the user fully deploying the firearm support.

FIGS. 5 and 6 show the stand 10 in the process of deployment. Referring first to FIG. 5, once the stand 10 has been drawn over the shoulder, the right hand may then grasp the rifle saddle 58 while the left hand pushes the gripping post 56 away from the user, opening the device in the scissors direction. Normally the device will be opened in the scissors direction to the point of stop-limit when in use, as this provides the optimum distance between the two rifle-contact points—the rifle saddle and the gripping post. This may be accomplished by providing a cord or cable, preferably with a retractor such as the common torsion-spring badge-holder, linking one or more of legs 1 and 3 with one or more of legs 2 and 4.

Alternatively, to limit opening of the device in the scissors direction, one or more pins or bent tabs may be provided in close proximity to one or both lower pivot points, which protrude perpendicularly from the adjacent side of the leg in the direction of its mating leg. For each stop-pin, the mating leg is provided with a stop feature such as an arcuate slot on the mating side of the leg facing the stop-pin, and aligned with the stop-pin. The stop pin contacts or nearly contacts one end of the slot when the device is closed, and contacts the other end of the slot when the device is opened to a point where the lower hinge points are pivoted to the desired working opening in the "scissors-direction" of a leg-angle of about 20 to 60 degrees, or sometimes about 35 to 40 degrees.

Typically, as shown in FIG. 6, the middle and ring fingers then manipulate the device into the open position in the spreading direction, and the fully opened device is placed on the ground in front of the user. This opening action may be facilitated by the use of torsion springs at one or both lower and/or upper hinge points. A cord, cable, or other means may be provided linking one or more of legs 1 and 2 with one or more of legs 3 and 4 to limit opening of the device in the spreading direction. Another way to accomplish this is by one or more legs protruding slightly above the hinge point and coming into contact with its upper-hinge mating leg, which may already be extended upward beyond the hinging point, such as in the case of a gripping post leg-extension, or which may also be only slightly extended above the hinge point. Normally the device will only be opened in the upper hinge pivot direction, hereinafter referred to as the "spreading direction", to some portion of the maximum angle of about 45 to 75 degrees, sometimes about 60 degrees when in use, as this angle dictates the elevation of the rifle saddle and gripping post from the ground surface.

Ideally, when the device is drawn over the shoulder and held horizontally, the device will remain securely in the closed position until the user shears the magnetic bonds, which secure the device in the undeployed state, and which will be described further below, by pulling the upper hinge mechanism of legs 2 and 4 via the rifle saddle toward the body with one hand and/or pushing the upper hinge mechanism of legs 1 and 3 via the gripping post away from the body with the other hand, thereby pivoting the lower hinge points to the fully opened position. This action of opening the device in the scissors direction and breaking the magnetic bonds will allow gravity to open the device in the spreading direction, whereupon the fingers of the left hand can be slipped into position for a one-hand hold. Due to the hinges being bent slightly more or less than is necessary to align the upper pivot axes when the device is fully opened in the scissors direction, the device stays open in the scissors direction when subsequently opened and held open in the spreading direction by the fingers of one hand. This allows for one-hand placement of the deployed device into the desired position on the ground in proper alignment with the target, while the other hand is free to initialize performance of the quick and well-known process of swinging the rifle nearly a full turn off the sling shoulder with the dominant hand and into position for the other hand to grasp the fore-end of the rifle for placement onto the device. Alternatively, once the device is deployed on the ground, the right-handed user may then grasp the rifle sling with the left hand at the right shoulder and, supporting the rifle butt with the fingers of the right hand, may kneel on the left knee while the right thigh supports the butt of the rifle for unslinging the rifle from the shoulder. The right arm is drawn from within the sling and grasps the pistol grip of the rifle, while the left hand shifts from the rifle sling to the fore end of the rifle.

The concept of designing for the application of shear-force perpendicular to the holding direction of pairs of magnets to provide self-securing means of closure and rapid-deployment capability to this device, as well as to other folding and scissors-type devices, including other forms of folding shooting aid devices, is hereby claimed. With practice, proper placement of the device and rifle for the shot at hand becomes smooth and steady in motion, particularly when using the previously mentioned one-hand device placement and dominant hand rifle-swing method, and target acquisition to the point of minute-of-angle holding stability can be accomplished within a few seconds of target sighting. Although the legs are described as being held adjacent in the collapsed state by a pair or magnets, it is within the purview of the invention that the legs could be coupled by one magnet and one metallic element, and that other connection means could be used, such as hook and loop fasteners, and other mechanical latching means.

Figure 7:
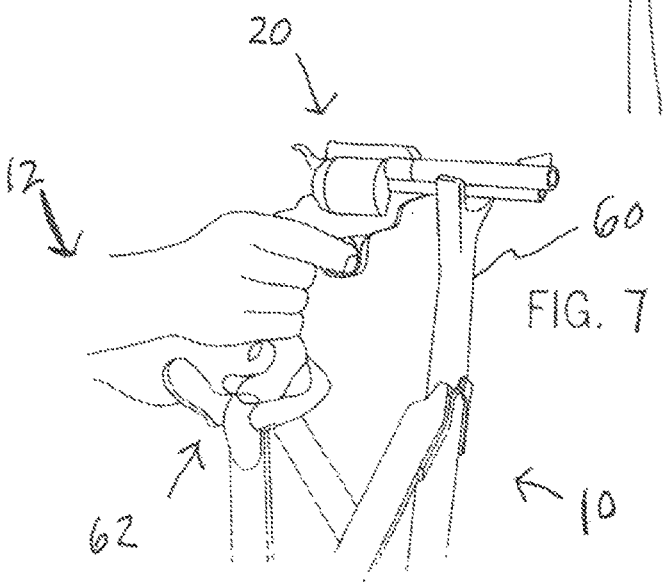
FIG. 7 illustrates a top portion of the firearm support supporting a handgun being used by the user.

FIG. 7 shows one embodiment of the stand 10 being used to support a handgun 20. The base design may be similar to that of the rifle version, with differences being found in the saddle design and the typical method of use. In the rifle version, the "rifle saddle" is typically located adjacent the upper hinge point nearest the user when opened, and a gripping post adjacent the upper hinge point farthest from the user when opened. In the handgun version, the pistol saddle 60, shown here in the form of a small forked upward protrusion designed to fit the barrel/shell-ejector of a revolver—is mounted adjacent the upper hinge point farthest from the user. The upper hinge point nearest the user may have no attachments, in which case the hand gripping the gun butt may rest on the other hand, which can then adjust the elevation of the gun butt by squeezing to hold higher on the tapered hinge point, or relaxing the grip to hold lower on the hinge point. Additionally, the upper hinge point nearest the user may have an attachment similar to a rifle saddle, but including only a rounded protrusion 62 specifically designed to allow over-the-shoulder grasping, without blocking hand access to the top of the legs.

Alternatively, the upper hinge point nearest the user may be the area of attachment of a sliding gun butt rest. This feature may comprise a section of material mounted movably in the linear direction to one of the near legs, that can be slid upward and held or locked in position for supporting the gun butt at an elevation which provides proper alignment of the sights with the target. This may be accomplished by such means as squeezing the gun butt rest against the leg with the non-shooting hand, or by squeezing a clamp-release mechanism with the non-shooting hand to allow the butt-rest to be elevated to the desired position, and then releasing the mechanism to lock the butt-rest in place.

In one embodiment, when gripped and drawn from the hip-mounted holster, as described above in regard to FIG. 2, deployment can be accomplished with only the hand gripping the pistol saddle post. In the case of a right-handed shooter, the pistol saddle is mounted on leg 1, and the bottom of the opposite leg, in this case leg 4, is somewhat longer than the other legs. When the device is drawn with the left hand and brought to the ground, leg 4 comes into contact with the ground. The user then twists the top of the pistol saddle forward, releasing the device in the scissors direction, allowing the bottoms of legs 1 and 3 to move toward the user. Next, the user twists the top of the pistol saddle to the right, swinging the bottoms of legs 1 and 2 leftward to create the fully opened device. This sequence of movements can be accomplished in 1-2 seconds on fairly even ground, and can be performed simultaneously with the drawing of the handgun from a holster, enabling the user to achieve solid target acquisition within 2-3 seconds of sighting.

FIGS. 8-15 show the portable firearm support stand 10 in a folded state. The stand 10 has four (4) legs, namely first leg 40, second leg 42, third leg 44 and fourth leg 46. Legs 40, 42, 44 and 46 preferably have a rectangular configuration with a relatively wide side "A" side and a thinner side "B". In this embodiment the width of face A is approximately 1.25 inches and the thickness of edge B is 0.25 inches. The leg length in this embodiment is approximately 33 inches. The legs are constructed of a rigid, lightweight material such as wood, plastic or metal. The first and second legs 40 and 42 are pivotally connected by pivot pin 48 at approximately their midpoint. Third and fourth legs 44 and 46 are similarly pivotally connected at approximately their midpoint region by pivot pin 50. First and third legs 40 and 44 are pivotally connected at their top ends, preferably by a hinge 52. Similarly, second and fourth legs 42 and 46 are pivotally connected at their top ends, preferably by hinge 54. The top end of first leg 40 preferably has a handle or handle region 56 that extends above the top end of the other legs 42, 44 and 46 to provide a grasping handle as both an aid for carrying and for deploying the stand 10. A support member 58 is disposed at the top end of the second and fourth legs 42 and 46 for engaging a firearm 14.

In order to achieve the desired utility, four basically rectangular bars or tubes of a rigid material such as wood, metal, carbon fiber, etc. are prepared appropriately for use in what will be mainly an outdoor device. Wood may be oiled, varnished or otherwise treated to protect it from extremes of heat and humidity. Metal, such as aluminum, may be anodized or painted to accomplish the same. The four bars or tubes, hereinafter referred to as legs, may also be coated with materials such as Teflon, polyurethane, rubbers, etc. that will reduce friction between the four legs and/or between the legs and other surfaces, and/or which may deaden the sound of the legs rubbing or bumping together. These four legs are arranged in a stack, generally hut not necessarily, with the wider sides facing one another, hereinafter referred to as the "adjacent sides".

Two upper hinges are provided. Typically, with the four legs numbered sequentially from left to right from the user's perspective, the upper hinges link leg 1 to leg 3 (partially hidden from view), and to link leg 2 to leg 4, as shown. The upper hinge axes run generally horizontal and generally parallel to the adjacent sides of the legs. These hinges may be mounted at or bent to an appropriate angle to align or early align the upper hinge axes when the device is opened in the "scissors" direction, in which two hinged legs are separated from the other two hinged legs via scissors-action rotation of the "lower pivot points", described below.

An upward protrusion, typically of leg 1, is provided, referred to herein as a "gripping post", for supporting the fore end of a rifle with the non-trigger hand when the device is in the opened condition. This post may be an extension of the leg, an elongated protrusion of a hinge plate, an insert, or an attachment. A second upward protrusion, typically of leg 2, is provided, referred to herein as a "rifle saddle", for supporting the rifle, typically just forward of the trigger guard, when the device is in the opened condition. The rifle saddle may be an extension of the leg, an elongated protrusion of a hinge plate, an insert, or an attachment. At the lower pivot points, "lower pivot members" are provided to join legs 1 and 2, and to join legs 3 and 4. These lower pivot members may pass most or all of the way through the legs, such as in the case of solid bars of wood or other material, or may pass only through the adjacent walls if tubes are used. Between the conjoined legs, and surrounding the lower pivot members, a thin wear surface may be provided.

Figure 16:
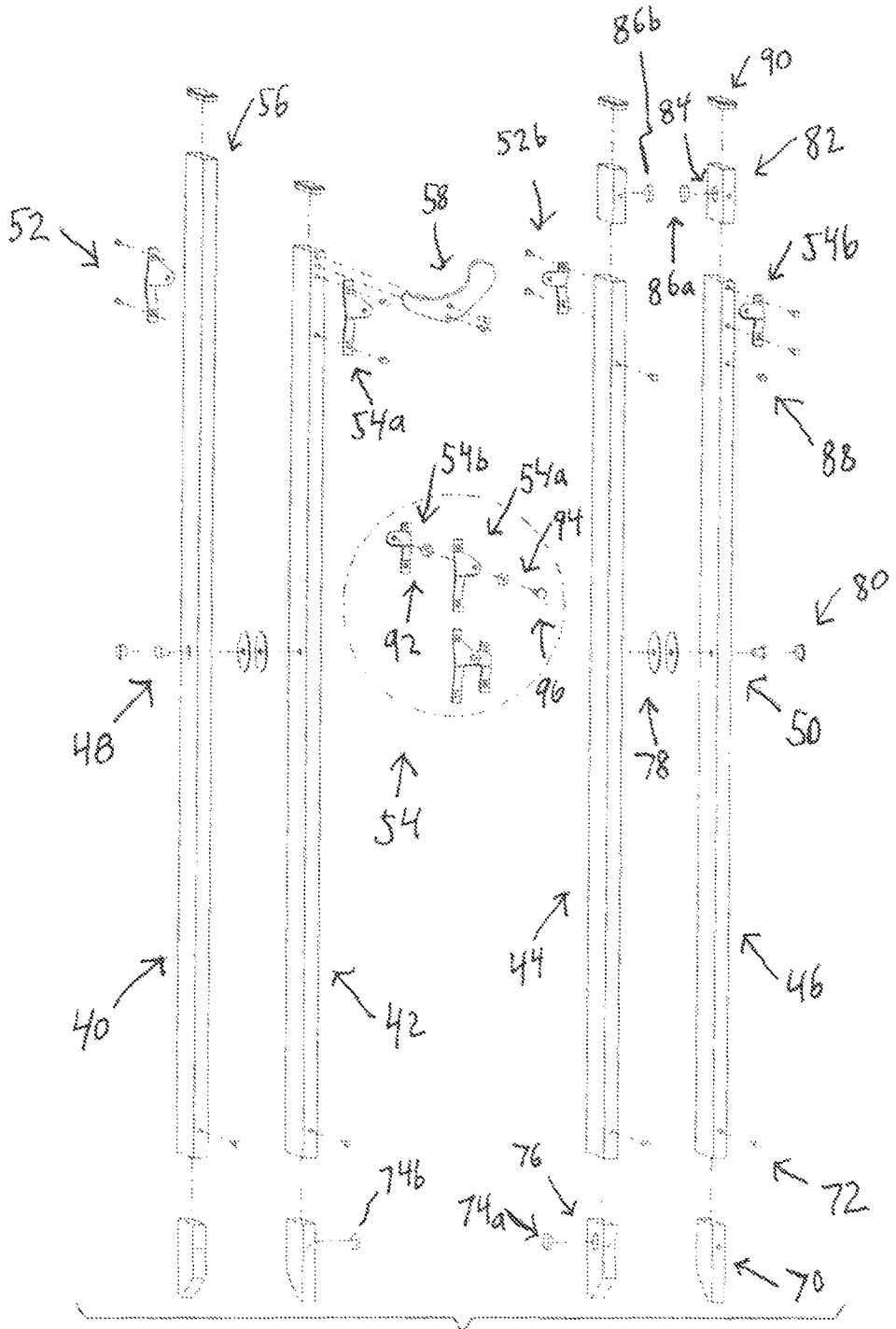
FIG. 16 is an exploded view of an embodiment of a firearm support.

FIG. 16 is an exploded view of one embodiment of the device which allows the utility of the magnets and inserts to be understood. In order to secure the device in the closed position when not in use, magnets may be provided to prevent inadvertent rotation of the upper hinges and/or lower pivot points. Inadvertent rotation of the lower pivot points, which results in the scissors-action separation of legs 1 and 3 from legs 2 and 4, may be prevented by mounting magnets 86, preferably disc type, with opposite polarities facing one another roughly flush with the adjacent surfaces of (preferably either the upper or the lower portions of) legs 1 and 2, and/or legs 3 and 4. Inadvertent rotation of the upper hinges, which results in separation of legs 1 and 2 from legs 3 and 4 in the "spreading" direction via rotation of the upper hinges, is prevented by mounting magnets 74, preferably disc type, with opposite polarities facing one another roughly flush with the adjacent surfaces of (preferably the lower portions of) legs 2 and 3.

In the case of tubular legs, as shown, these magnets may be press-fit or glued into depressions in a block of material 82 or foot insert 70 which is pressed or otherwise fastened into the tubing, hiding the magnet under the surface of the tubing for a durable and cosmetically pleasing construction, or they may be secured with adhesive or other means to the opposite tube wall by using spacers of a suitable material. Magnets may be press-fit, glued, screwed, or otherwise fastened into depressions in the surface of solid-material legs.

It should be noted and understood that the linking, via the upper hinges, of the upper ends of leg 1 to leg 3, and of leg 2 to leg 4, along with the linking, via the lower pivot members, of leg 1 to leg 2, and leg 3 to leg 4, is at the heart of the invention, for it is this configuration that allows the user to open the device with the scissors-action of the legs causing a perpendicular shearing of the magnetic forces that hold the legs in parallel orientation when the device is in the closed position, thus requiring much less force to break the magnetic bonds than the "pull" rating of the magnets used. It should also be noted that the same utility can be achieved by the linking, via the upper hinges, of the upper ends of leg 1 to leg 4, and of leg 2 to leg 3, if the lower pivot points are located at unlike distances from any given point along the length of the device in order to provide the necessary magnetic force-shearing geometry. There are advantages to either upper hinging pattern, but this document is focused mainly on the leg 1 to leg 3 leg 2 to leg 4 upper hinging pattern for purposes of example.

Tubular legs may employ caps or inserts 70, as shown, that include ground contact features such as rubber tread, or angled and/or tapered ends, either rigid or supple, to provide ground-contact surfaces with sufficient gripping capability. Solid legs may be cut at an angle or taper to provide a better grip on the ground, or may be recessed to accept foot-caps of plastic, rubber, or other appropriate material. Any of these lower caps or inserts may be provided in different lengths to provide height adjustment for different size users, and may include a spring-loaded telescoping action to compensate for slight inconsistencies in ground flatness. In cases of gross ground flatness inconsistency, three ground contacting legs are sufficient for stability of the device in use. In fact, any one of the four legs of this device may be cut off below the lower pivot point without severely affecting performance of the device, or either lower pivot point may be at or near ground level to provide only three-points of ground contact, but the basic four-leg double-scissors design offers the advantage of choosing, according to the angle of elevation desired, the three legs that will contact uneven ground by leaning the rifle/device forward or rearward until the third leg comes into contact with the ground.

Further, preferred details of the embodiment of FIG. 16 are as follows. In this case leg 1 is extended to form a gripping post above the upper hinges. The four legs are less than 72" in length, sometimes 24-44" in length, and often 32-36" in length. The adjacent sides of the legs may measure about 0.50" to 3", sometimes 1" to 2", and often 1.25" to 1.5", and the non-adjacent sides may measure 0.15" to 1", sometimes 0.25" to 0.50", and often about 0.3" to 0.4". In the case of tubes, of metal, fiberglass, carbon fiber or other suitable material, the thickness of the tube walls may be 0.01" to 0.12", sometimes 0.02" to 0.05". In order to prevent excessive sound generated by opening and closing the device in the field, bumping against objects, etc., material such as expanding foam may be injected into the tubes prior to capping the tube ends. Further parts include:

70—Foot insert: Molded, cut, or machined, solid or hollow, pressed, screwed, or otherwise fastened into the base of the tubular leg

72—Foot insert fastener: One or more screws, pins, rivets, etc.

74—Lower Magnet: Preferably disc-type, with a diameter of 0.2" to 1", and sometimes about 0.4", a thickness of 0.05 to 0.3", and sometimes about 0.12", and with a maximum pull force of 1 lb. to 10 lbs., and sometimes 2 lbs. to 5 lbs., with opposite polarities facing one another.

76—Magnet socket: Allows magnet to be glued or pressed into foot insert for positioning magnet under the surface of the tubular leg in the finished form

78—Wear surface washers: One or more washers of a wear-resistant material such as UHMW polyethylene between the legs, and surrounding the lower pivot members, with an inner diameter slightly larger than the diameter of the lower pivot member, an outer diameter slightly smaller than the width of the adjacent sides of the legs, and a thickness of 0.005" to 0.080", sometimes 0.010" to 0.050", and often 0.015" to 0.030".

48, 50—Lower pivot members: Small pin, nail, bolt or rivet, of a diameter of roughly 0.03" to 0.3", and sometimes 0.06" to 0.2", are provided to join legs 1 and 2, and to join legs 3 and 4, sometimes about one-fourth to three-fourths the distance from leg end to leg end, often a few inches above the center-points, and roughly centered on the adjacent sides of the legs.

80—Lower pivot member access hole cap: Commercial or custom cap, such as molded plastic.

**52*a*—Rear major hinge plate and fasteners: Attaches to rear, non-adjacent side of leg 1** with one or more screws, rivets, or other fastening means. Mates with rear minor hinge plate.

**54*a*—Front major hinge plate and fasteners: Attaches to front, non-adjacent side of leg 2** with one or more screws, rivets, or other fastening means. Mates with front minor hinge plate.

**52*b*—Rear minor hinge plate and fasteners: Attaches to rear, non-adjacent side of leg 3** with one or more screws, rivets, or other fastening means. Mates with rear major hinge plate.

54*b*—Front minor hinge plate and fasteners: Attaches to front, non-adjacent side of leg 4 with one or more screws, rivets, or other fastening means. Mates with front major hinge plate.

58—Rifle saddle and fasteners: In this case, an attachment-style saddle, screwed, riveted, or otherwise fastened to the leg

82—Magnet socket insert: Molded, cut, or machined, solid or hollow, pressed, screwed, or otherwise fastened into the upper or lower portion of the tubular leg

84—Magnet socket: Allows magnet to be glued or pressed into the insert for positioning magnet under the surface of the tubular leg in the finished form

86—Upper Magnet: Preferably disc-type, with a diameter of 0.2" to 1", and sometimes about 0.4", a thickness of 0.05" to 0.3", and sometimes about 0.1", and with a total maximum pull force of 0.5 lb. to 8 lbs., and sometimes 1.5 lb. to 4 lbs., with opposite polarities facing one another.

88—Magnet socket insert fastener: One or more screws, pins, rivets, etc.

90—Tube cap: Upper and/or lower tube ends may be capped, if so desired, by inserting standard commercial polymer tube caps or plugs, or custom-made caps or plugs of the desired form.

54*b*—Minor hinge plate: Resides under and is mated to the major hinge plate. Aluminum or other rigid material, about 0.030" to 0.2", sometimes 0.06" to 0.13" in thickness.

92—Inner wear surface washer: One or more washers of a wear-resistant material such as UHMW polyethylene, with an inner diameter slightly larger than the diameter of the hinge pivot member, an outer diameter slightly smaller than the mating surface of the hinge halves, and a thickness of 0.005" to 0.060", sometimes 0.010" to 0.040", and often 0.015" to 0.030".

54*a*—Major hinge plate: Resides over and is mated to the minor hinge plate. Aluminum or other rigid material, about 0.030" to 0.2", sometimes 0.06" to 0.13" in thickness.

94—Optional outer wear surface washer: One or more washers of a wear-resistant material such as UHMW polyethylene, with an inner diameter slightly larger than the diameter of the hinge pivot member, an outer diameter slightly smaller than the mating surface of the hinge halves, and a thickness of 0.005" to 0.060", sometimes 0.010" to 0.040", and often 0.015" to 0.030". This washer may be covered with a rigid washer of a material such as metal under the head of the hinge pivot member to utilize the entire wear surface.

96—Hinge pivot member: A small bolt, pin, or rivet of a diameter of 0.06" to 0.25", and sometimes 0.10" to 0.20".

54—Assembled upper hinge NOTE: In general, the upper hinges can be mounted such that, when the device is in the opened position, the hinges are either on the side of the legs facing the other legs, or as is more typical, on the side facing away from the other legs.

Figure 17A:
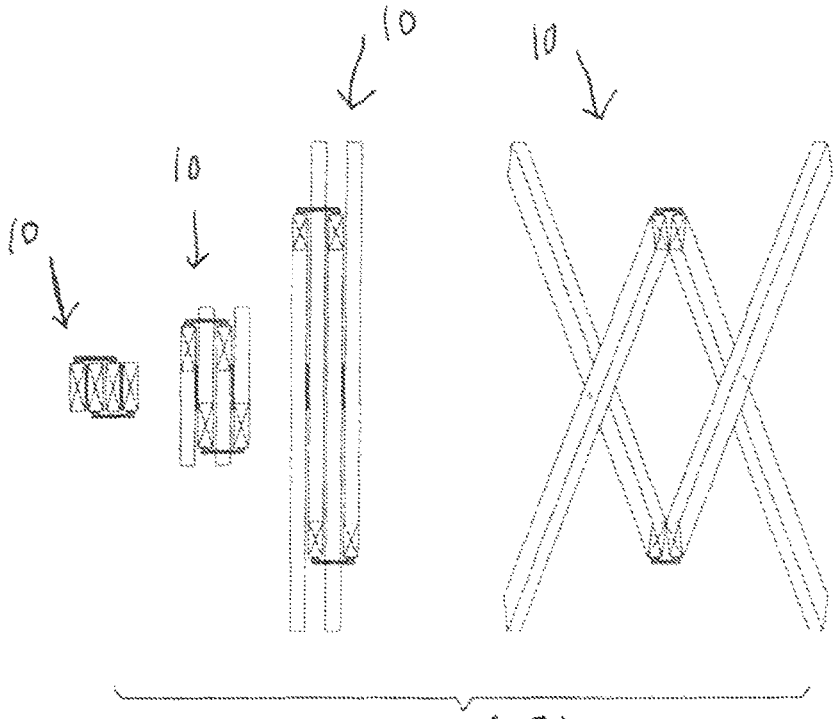
FIG. 17 A is a top view of various stages of deployment of another embodiment of the device.
Figure 17B:
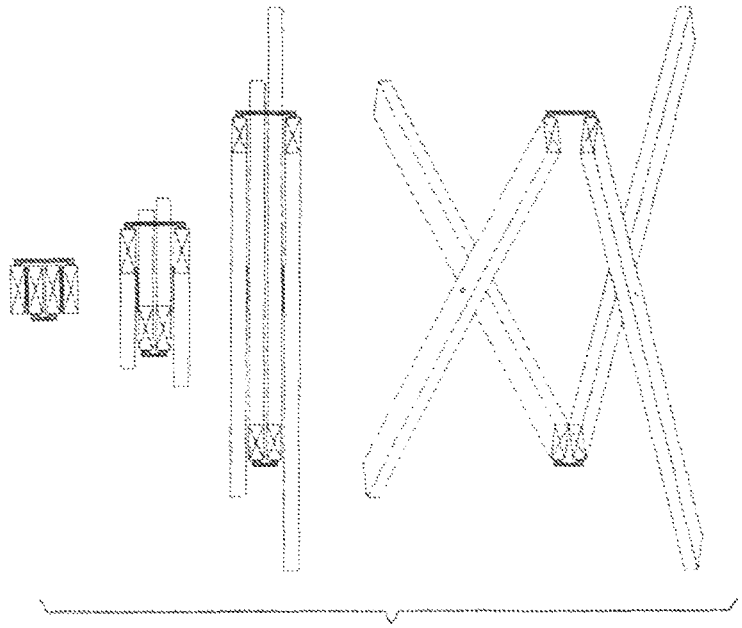

FIGS. 17A and 17B—The device is opened, or deployed, in two stages. First, in the scissors direction, to shear the force of the magnets that hold the device in the closed position, and then in the spreading direction, to ready the device for use. FIG. 17A depicts four top views of the device with upper hinges connecting leg 1 to leg 3, and leg 2 to leg 4. These views are, from left to right, device closed; device partially opened in the scissors direction; device fully opened in the scissors direction; and device subsequently opened in the spreading direction. FIG. 17B shows the same four views of the device with upper hinges connecting leg 1 to leg 4, and leg 2 to leg 3. These views are, from left to right, device closed; device partially opened in the scissors direction; device fully opened in the scissors direction; and device subsequently opened in the spreading direction.

Exemplary Hinging Methods

Figure 22:
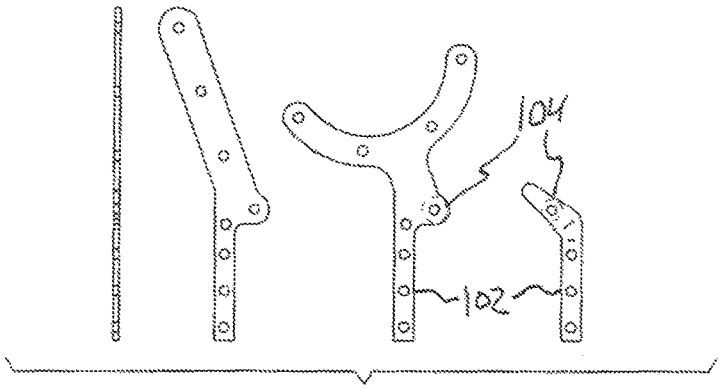
FIG. 22 illustrates components of the upper hinges in FIGS. 18 and 19.
Figure 19:
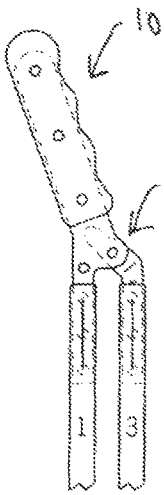
FIG. 19 illustrates another embodiment of an upper hinge.
Figure 18:
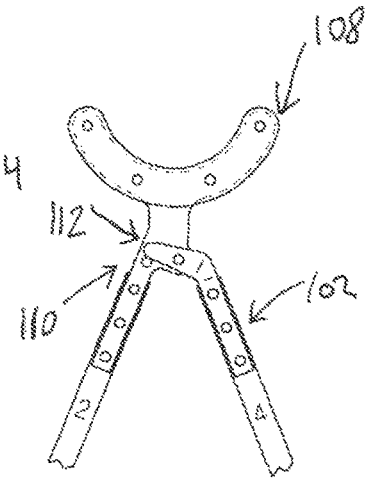
FIG. 18 illustrates an embodiment of an upper hinge of the firearm support of the invention.
Figure 20:
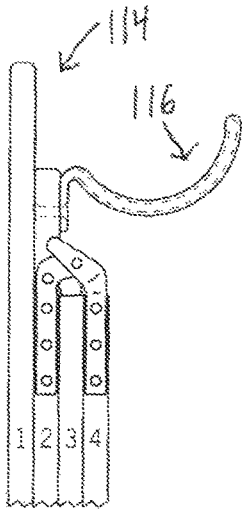
FIG. 20 illustrates another embodiment of an upper hinge.
Figure 21:
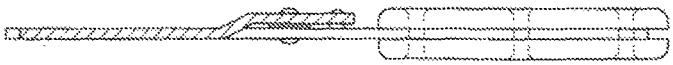
FIG. 21 illustrates a side view of an upper hinge assembly.

Referring to FIGS. 18-22, one method of hinging involves the use of hinge plates with integral gripping post and/or rifle saddle features. FIG. 22 depicts the various components of this hinge type. Each hinge is comprised of two plates, with each plate having an elongated section 102 with two or more holes for mounting it on a non-adjacent side and toward the upper end of one of the four legs, and a pivoting section 104 with one hole to mate it to the other hinge half. The upper hinge in FIG. 19 that typically joins legs 1 and 3 may be mounted on the side of the device farthest from the user, and may include an elongated upward protrusion on the primary plate, forming at least the tang of a gripping post 106. The upper hinge in FIG. 18 that typically join legs 2 and 4 may be mounted on the side of the device nearest the user, and may include a fork or bowl-shaped upward protrusion on the primary plate, forming at least the tang of a "rifle saddle" 108 for supporting the rifle, typically just forward of the trigger guard, when the device is in the opened condition. To limit opening of the device in the spreading direction, a stop-feature, such as a pin or tab 110, may be provided, which protrudes perpendicularly from one or more hinge plates in the direction of the mating plate. The mating plate or plates may be provided with an upward-angled protrusion 112 which is some distance from the stop-feature when the device is fully closed, and which comes into contact with the stop-feature when the device is opened to a point where the upper hinge points are pivoted to the desired maximum leg-angle of about 45 to 75 degrees, sometimes about 60 degrees. A side view of an assembled hinge is shown in FIG. 21. Typically, the plates comprising the upper hinges would be bent inward toward the leg about at the top of the surface where they mount to the leg, in order to align the upper hinge axes when the device is opened in the scissors direction. Alternative methods are shown in FIG. 20, wherein the gripping post 114 is provided by extending the length of leg 1, and the rifle saddle 116 is provided by attaching an appropriately bent rod or strap to a somewhat extended leg 2.

Figure 26:
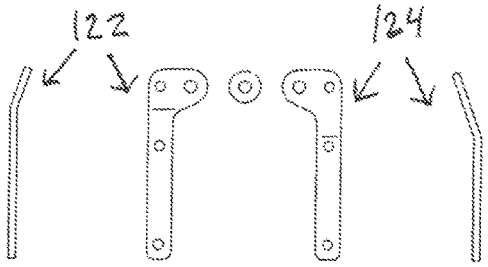
Figure 27:
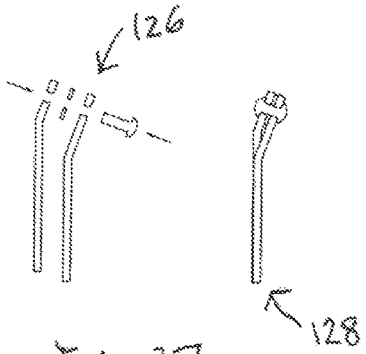
FIG. 27 illustrates assembly of a surface mount hinge
Figure 28:
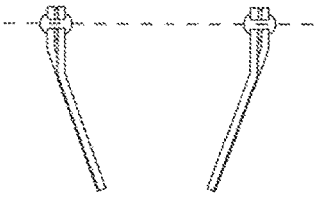
FIG. 28 illustrates alignment of hinge pins with device opened in the scissors direction.
Figure 29:
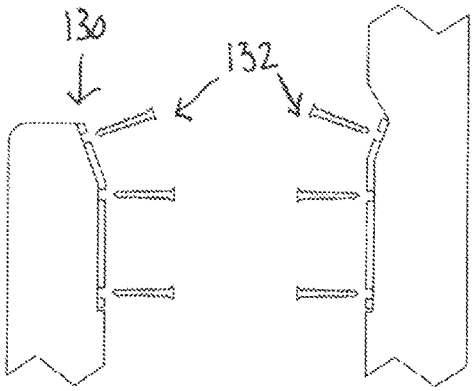
FIG. 29 illustrates attachment of the upper hinge plates of FIG. 26 to solid legs

FIG. 26-29—In another hinging method, both hinge plates, as shown in FIG. 26, can be bent at about half of the desired (approximately 35-40 degree) angle of opening, in this case about 19 degrees, with one plate 122 being bent at about the lower edge of the surface where it mates to the other plate, and the other plate 124 being bent at the appropriate elevation so that when assembled with the appropriate wear surface 126 in between the plates as shown in FIG. 27, the desired offset will be achieved to allow planar alignment 128 of the leg mounting surfaces of the two hinge halves. The axes of the two hinges will then be aligned or nearly aligned as in FIG. 28 when the device is opened in the scissors direction, to allow subsequent hinging in the "spreading direction" with little strain on the hinges. FIG. 29 shows how this hinge design can be particularly useful in hinging solid legs, such as wood, since the leg material can be carved or machined to the same contour as the hinge plates 130, which allows an upper fastener 132 to be employed directly adjacent the hinge point to reduce flexing of the hinge under load.

With this simple hinging system, leg 1 or leg 3 can be somewhat longer than other legs, allowing the natural upward protrusion to serve as a hand-gripping post for supporting the fore end of a rifle, perhaps to be subsequently dipped in rubber compound for improved grip. Also, leg 2 or leg 4 can be somewhat longer than other legs, and a simple curved piece of metal or other material can be fastened to the upward leg extension to form at least the core of the rifle saddle, perhaps to be subsequently dipped in rubber compound or otherwise improved.

Figure 30:
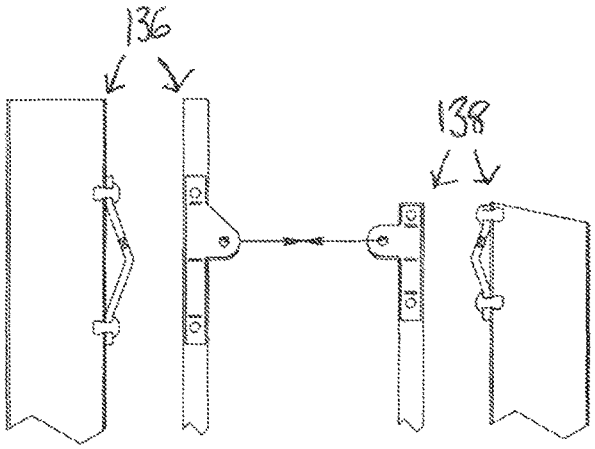
FIG. 30 illustrates another embodiment of an upper hinge.
Figure 31:
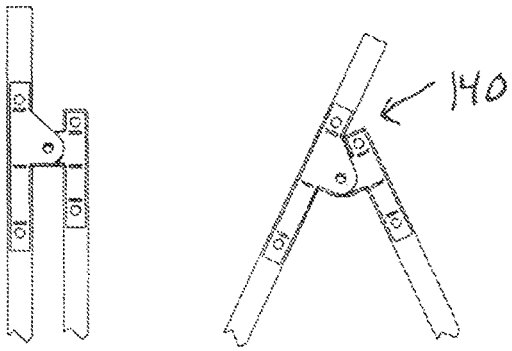
FIG. 31 shows the assembled upper hinge of FIG. 30 and an angle-limiting feature.

FIG. 30-31 illustrate yet another hinging method, primarily for use with hollow legs, such as rectangular tubing. As shown in FIG. 30, surface-mount hinges mounted on the non-adjacent sides of the extended legs 136, and non-extended legs 138 may be provided which are bent outward and then inward, and which, when assembled as in FIG. 31, provide an angled hinging-surface protrusion to provide free hinging of the device in the spreading direction when first opened in the scissors direction. This hinge design allows fasteners to be employed both above and below the hinging-surface protrusion for added stability, while also providing the spreading limitation feature of the non-extended leg top meeting the side of the extended leg at point 140 when opened to the angle of desired limitation.

Exemplary Folding Capability

Figures 23, 24, 25:
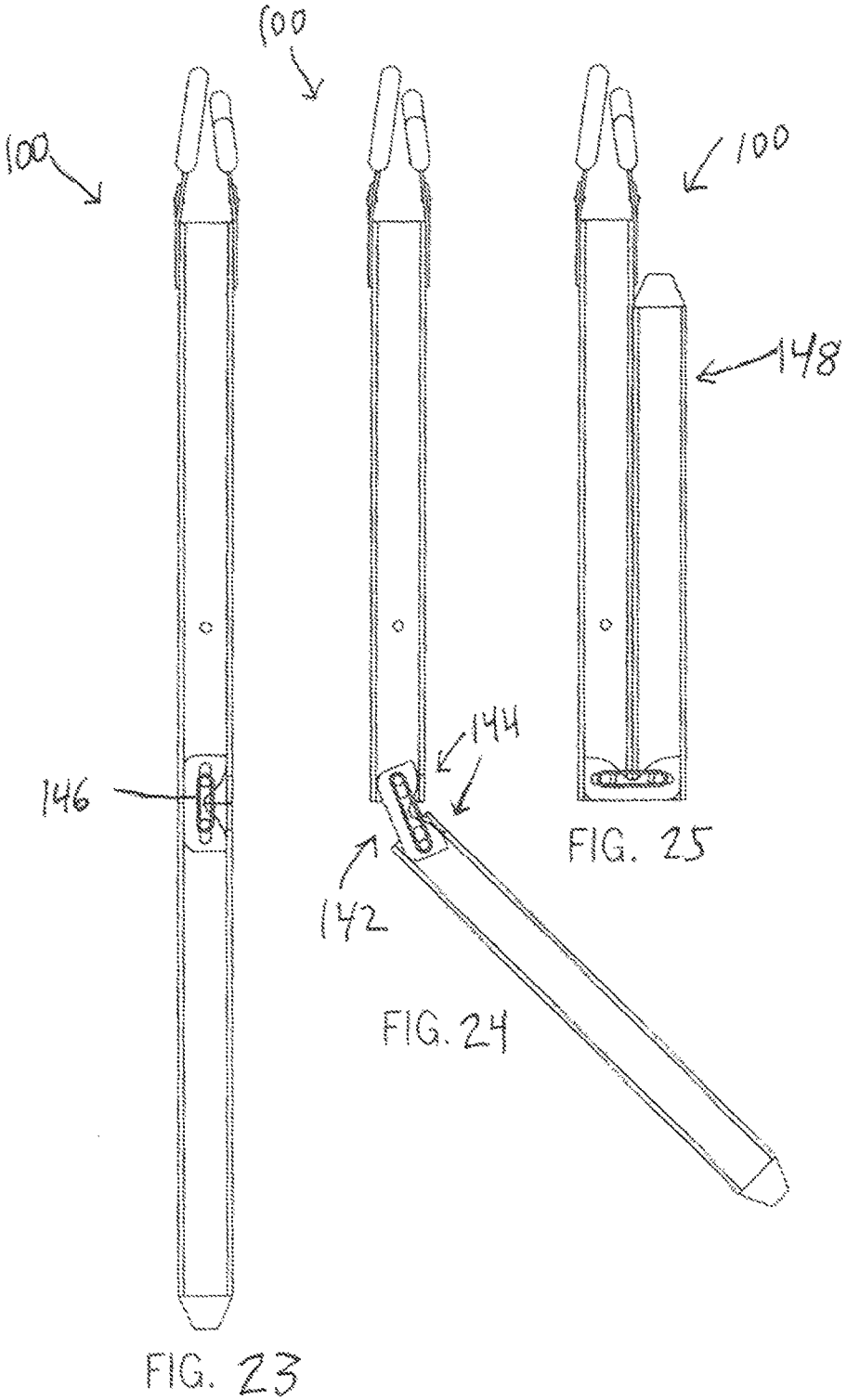
FIG. 23 illustrates a cutaway view of the device in the undeployed state for storage or transportation
FIG. 24 illustrates the device in a partially folded state
FIG. 25 illustrates the device in a fully folded state for packing or long term storage FIG. 26 components of a surface mount hinge

Another desirable feature may be provided to enable folding of a tubular-legged device into a more compact form for stowing in a pack or other small space, or for efficient general storage. In the example shown, once the device is in the closed position and not in use as in FIG. 23, the legs are all hinged in the scissors direction as shown in FIG. 24, with hinge axes parallel to the lower pivot members, to allow the lower leg sections to fold upward against the upper leg sections as in FIG. 25. In one embodiment, slotted hinge plates 142 within the legs slide on pins 144 that pass through the legs, and which are drawn together with elastic loops or extension springs 146. The non-hinged ends of the upper and lower leg sections be further secured by magnets or spring-clip inserts at point 148, or an elastic band or other gathering means may be employed in the same region.

A more economical hinging alternative would be the common slip fit and shock-cord approach used in the manufacture of most modern tent poles.

The invention provides a collapsible support for rifles, handguns and the like, comprising four solid or hollow legs, bars or tubes, oriented in a parallel stack, with four total hinge points somewhat perpendicular to the longitudinal direction of the legs, including two upper hinge points at or near the top of the legs with pivot axes parallel to the plane of the adjacent sides of the stacked legs, with one upper hinge point linking sequential leg 1 to leg 3 or leg 4, and the second upper hinge point linking sequential leg 2 to the other of leg 3 or leg 4; and including two lower hinge points located below the upper hinge points, with pivot axes parallel to the plane of the non-adjacent sides of the stacked legs, with one lower hinge point linking sequential leg 1 to leg 2, and a second lower hinge point linking sequential leg 3 to leg 4. The upper hinges may be constructed from stamped or otherwise formed plates, preferably metal, appropriately shaped, bent, and drilled. The plates may be stamped or otherwise formed so as to include the base shape of tools such as a rifle saddle, a handgun saddle, or a gripping post. The hinges may be attached to the non-adjacent sides of the upper portions of the stacked legs, with means such as rivets or screws. The plates may be stamped or otherwise formed so as to include an extension of the hinge plate, roughly the width of the leg, which can be bent to match the contour of an angle-cut or multi-angle-cut leg top, and can be fastened to the side of the leg opposite the hinge, thus forming both a cap for the leg and an angled surface for the protruding upper pivot portion of the hinge plate.

The embodiments above are chosen, described and illustrated so that persons skilled in the art will be able to understand the invention and the manner and process of making and using it. The descriptions and the accompanying drawings should be interpreted in the illustrative and not the exhaustive or limited sense. The invention is not intended to be limited to the exact forms disclosed. While the application attempts to disclose all of the embodiments of the invention that are reasonably foreseeable, there may be unforeseeable insubstantial modifications that remain as equivalents. It should be understood by persons skilled in the art that there may be other embodiments than those disclosed which fall within the scope of the invention as defined by the claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A stand for a firearm, comprising a foldable leg system including first, second, third and fourth legs, each leg having a predetermined length with a bottom, a top region and a midpoint region, each midpoint region being disposed above the bottom one third of the length of each leg, the top regions of the first and third legs being pivotally connected to each other, the top regions of the second and fourth legs being pivotally connected to each other, the midpoint regions of the first and second legs being pivotally connected to each other, and the midpoint regions of the third and fourth legs being pivotally connected to each other;

wherein, in a collapsed state, the first and third legs are connected by a first pivot point at the top region, the first pivot point having a first axis, and the second and fourth legs are connected by a second pivot point at the top region, the second pivot point having a second axis, the first axis being oriented at an angle between 20 and 60 degrees relative to the second axis;

wherein in an unfolded state, the first axis and the second axis are oriented in substantial alignment with each other;

wherein, in the collapsed state, the first and second legs are connected by a third pivot point at the midpoint region, the third pivot point having a third axis, and the third and fourth legs are connected by a fourth pivot point at the midpoint region, the fourth pivot point having a fourth axis, the third axis being oriented in substantial alignment relative to the fourth axis;

wherein in the unfolded state, the third axis and the fourth axis are oriented at an angle between 45 and 75 degrees relative to each other;

wherein the first and second pivot points are hinges, and wherein the third and fourth pivot points are selected from the group consisting of pins, bolts, and rivets;

wherein the legs have a rectangular crossectional geometry with a relatively wide face and a relatively short edge;

wherein the faces of the legs slidably abut each other to form a rectilinear stack when folded;

a handle disposed at the top region of a single leg; and a single point, firearm support disposed at the top region of a single leg.

2. The stand of claim 1, wherein the single leg that the handle is disposed on is the top of the first leg.

3. The stand of claim 2, wherein the handle is formed as part of the top of the first leg, and whereby the handle is disposed above the top of the remaining legs.

4. The stand of claim 2, wherein the firearm support is connected to the top of a leg, whereby the firearm support is disposed above the tops of the legs.

5. The stand of claim 1, wherein the firearm support has a U-Shaped configuration.

6. The stand of claim 1, wherein the legs have at least one magnetic connector disposed thereon to hold the legs adjacent to each other in a collapsed state.

* * * * *